United States Patent [19]

Hashimoto

[11] Patent Number: 4,900,003

[45] Date of Patent: Feb. 13, 1990

[54] SHEET CONVEYING APPARATUS

[75] Inventor: Kenichiro Hashimoto, Yokohama, Japan

[73] Assignee: Canon Kabushiki Kaisha, Tokyo, Japan

[21] Appl. No.: 267,098

[22] Filed: Nov. 4, 1988

[30] Foreign Application Priority Data

Nov. 9, 1987 [JP] Japan ..... 62-280998
Nov. 9, 1987 [JP] Japan ..... 62-170058[U]

[51] Int. Cl.[4] ..... B65H 3/06
[52] U.S. Cl. ..... 271/114; 271/118
[58] Field of Search ..... 271/114–118, 271/10

[56] References Cited

U.S. PATENT DOCUMENTS 2,791,425 5/1957 Ford et al. ..... 271/116
4,645,192 2/1987 Watanabe ..... 271/114

FOREIGN PATENT DOCUMENTS 169428 7/1986 Japan ..... 271/10

*Primary Examiner*—H. Grant Skaggs
*Attorney, Agent, or Firm*—Fitzpatrick, Cella, Harper & Scinto

[57] ABSTRACT

A sheet conveying apparatus for conveying a sheet comprises a separation rotary member for separating a single sheet from a plurality of sheets and feeding the sheet, a supply rotary member for supplying the sheet toward the separation rotary member, driving means for generating a driving force to rotate the separation rotary member, intermission means for intermitting the transmission of the driving force from the driving means, operating means for shifting the supply rotary member between a supplying operation position and retracted position retracted from the supplying operation position, and driving force transmitting means for performing the transmission or interruption of the intermission means, in synchronism with the shift of the supply rotary member to the retracted position or to the supplying operation position by means of the operating means.

5 Claims, 6 Drawing Sheets

SHEET CONVEYING APPARATUS

BACKGROUND OF THE INVENTION

1. Field of the Invention

The present invention relates to a sheet conveying apparatus for conveying a sheet in a predetermined direction.

Here, the "sheet" in this disclosure includes, for example, a recording sheet on which an image or images are recorded or printed, and an original sheet having an image or images to be read. The sheet conveying apparatus according to the present invention can be applied to image recording apparatuses, image reading apparatuses, document feeding mechanisms or the like. More particularly, the present invention is applicable to facsimile machines, copying machines, printer apparatuses, word processors, electronic typewriters and the like.

2. Related Background Art

In the past, each of printer machines, facsimile machines and the like included a sheet feeding mechanism for feeding out sheets one by one, as needed, from a sheet stack. Such a sheet feeding mechanism is generally constituted by pick-up rollers for picking up a sheet and sheet feeding rollers for feeding out sheets one by one, and the sheet is fed by rotating these rollers under the control of a control circuit.

Accordingly, in the conventional sheet feeding apparatuses, it was necessary to include, at least, a motor for rotating pick-up rollers, which is controlled and driven by a control circuit and a driving circuit, and a sheet feeding motor, or an electro-magnetic clutch and motor which are directly driven by a control circuit and a driving means.

However, with such construction, since the exclusive motors were provided for the pick-up rollers and sheet feeding rollers, respectively, the control means and the driving circuits had to be prepared for each of the motors, thus making the whole system complicated, large-sized and expensive.

An example of the conventional sheet conveying apparatus utilized in a sheet discharging section is shown in FIGS. 7A–7E. FIGS. 7A and 7C are plan views of the conventional sheet conveying apparatus for discharging the sheet, and FIGS. 7B, 7D and 7E are side views of such sheet conveying apparatus. As shown, the conventional sheet conveying apparatus arranged in the sheet discharging section includes discharging rollers 203 comprising a plurality of high friction rubber rollers substantially equidistantly arranged on a shaft or core bar 207, and discharging members 209 (FIG. 7A) or discharging springs 201 (FIG. 7C) arranged on a support 202 and protruding toward the core bar 207 between the rollers 208.

In the sheet conveying apparatus so constructed, when the discharging rollers 203 are rotated in a direction a which corresponds to a sheet conveying direction, since the discharging rollers 203 do not contact any members, the rollers can rotate without any load. Here, when a sheet S is supplied from a direction b by means of an appropriate sheet supplying mechanism (not shown) and the end of the sheet S is fed to a pinching position between the discharging rollers 203 and the discharging members 209 (FIG. 7A) or the discharging springs 201 (FIG. 7C), a driving force will act on the pinched end of the sheet, because the pressing force to rotating rollers 203 acts on the sheet at the discharging members 209 or springs 201, thus applying the frictional driving force to the sheet S.

However, in the conventional sheet conveying apparatus mentioned above, there is a problem that the sheet may be jammed when a thin sheet is used, or the sheet can not be fed out when a thick sheet is used.

That is to say, when the sheet S shown by an alternate long and short dash line in FIGS. 7A–7D is thin, since the sheet is weak and there has not enough rigidity to endure the discharging rollers 209 or discharging spring 201, the sheet may be deformed in a wave shape. Consequently, in this case, the deformed sheet may be jammed between the discharging rollers and the discharging members or springs. On the other hand, when the sheet S is thick and has high rigidity, as shown in FIG. 7E, the discharging springs 201 may be deflected excessively by the thick sheet since the spring force can not overcome the rigidity of the sheet, with the result that the sheet S to be fed may not contact the discharging rollers 203. Accordingly, in this case, even when the discharging rollers 203 are driven, the driving force does not act on the sheet, whereby the sheet can not be discharged.

SUMMARY OF THE INVENTION

An object of the present invention is to provide a sheet conveying apparatus which can increase or improve the reliability of operation of the apparatus by decreasing the number of parts which constitute the apparatus.

Another object of the present invention is to provide a sheet conveying apparatus which is compact to decrease an installation space therefor.

Other object of the present invention is to provide a sheet conveying apparatus which is less expensive by decreasing the number of parts which constitute the apparatus.

A further object of the present invention is to provide a sheet conveying apparatus which is constituted by the least driving sources and constructural parts and which is highly reliable, inexpensive and compact.

The other object of the present invention is to provide a sheet conveying apparatus which can positively feed a sheet even when the sheet is thin or thick.

DETAILED DESCRIPTION OF THE PREFERRED EMBODIMENTS

Figure 1:
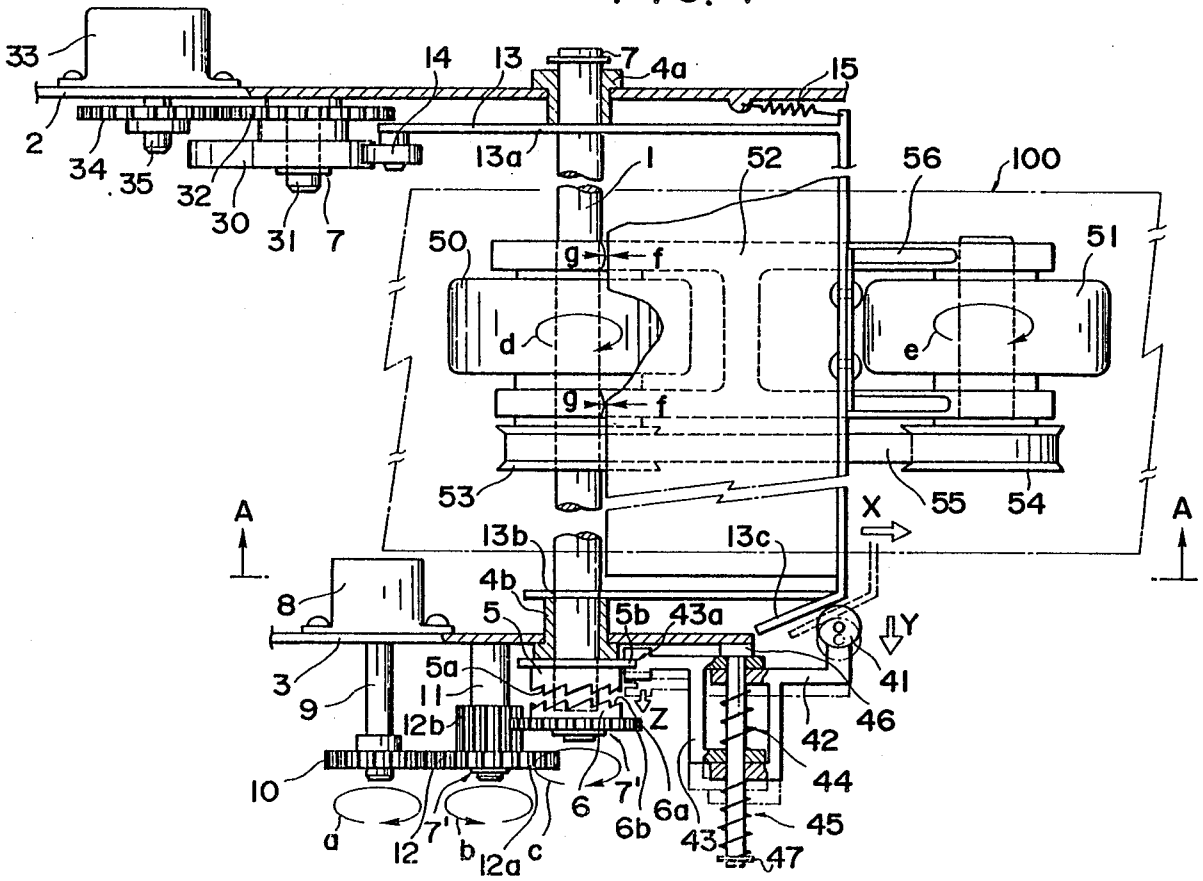
FIG. 1 is a partial sectional plan view of a sheet conveying apparatus according to an embodiment of the present invention.

A sheet conveying apparatus according to an embodiment of the present invention explained hereinafter comprises a rotatably supported rotary shaft, sheet feeding rollers attached to the rotary shaft for feeding a sheet, a driving means for driving the rotary shaft, and a clutch control means for controlling whether the driving force generated by the driving means is transmitted to the rotary shaft or not. The clutch control means includes a first meshing member provided at one end of the rotary shaft for slidable movement in an axial direction of the rotary shaft and for rotation together with the rotary shaft, a second meshing member which can mesh with the first meshing member and which is rotated by the rotational force from the driving means, a rocker member rotatably supported by the rotary shaft, a rotation transmission portion provided on a part of the rocker member, a transmission mechanism for converting a direction of rotation of the rocker member and transmitting an amount of rotation thereof, and a guide mechanism for guiding the first meshing member.

In the sheet conveying apparatus constructed as above, the sheet feeding operation is effected, for example, as follows: that is to say, first of all, the second meshing member always rotated by a motor is meshed by the first meshing member, thereby transmitting the rotational force of the driving means to the rotary shaft. This is effected in such a manner that the rotation transmission portion provided on a part of the rocker member rocked by means of a cam changes the movement direction of the rocker member and transmits the amount of movement of the rocker member, thus engaging the first meshing member and the second meshing member with each other by means of the guide mechanism for guiding the first meshing member. Consequently, the rotational force of the driving means is transmitted to the shaft of the rollers. The sheet feeding rollers made of high friction material such as rubber are fixedly mounted on the rotary shaft, and pick-up rollers are provided for rotating in synchronism with the rotation of the sheet feeding rollers. The sheet feeding rollers and pick-up rollers constitute a roller assembly which is rocked upwardly and downwardly around an axis of rotation of the rotary shaft by the rotational force of the rocker member through a cam. When the roller assembly is rocked downwardly, the rollers engage with the sheet to feed the same. In this condition, since the rotational force of the driving means has been transmitted to the rotary shaft, the rotational force is also transmitted to the sheet feeding rollers and pick-up rollers. In this way, in the sheet conveying apparatus according to the embodiment of the present invention, the number of the driving sources and of the constructural parts is minimized by cooperation of each of the rollers and the clutch by the operation of the cam.

Next, an embodiment according to the present invention will now be explained in reference with FIGS. 1–4.

(The rotary shaft assembly)

First of all, a rotary shaft assembly will be explained hereinafter. FIG. 1 is a partial sectional plan view of a sheet feeding mechanism according to the present invention. In FIG. 1, a rotary shaft 1 is rotatably supported by left and right bearings 4*a* and 4*b* arranged in left and right side plates 2 and 3 which constitute a body. An E-ring 7 is attached to one end of the rotary shaft 1. On the other end portion of the rotary shaft 1 supported by the right bearing 4*b*, a slidable dog clutch (first meshing member) 5 and a dog clutch (second meshing member) 6 are arranged in such a manner that the slidable dog clutch 5 is slidable in the axial direction of the rotary shaft 1 and is rotated together with the rotary shaft 1, whereas the dog clutch 6 is rotatably supported around the rotary shaft 1 and is prevented from slipping off the rotary shaft by means of a stopper ring, such as E-ring 7 and the like. The reference numeral 100*a* (FIGS. 3 and 4) designates a loading base on which the sheets S are stacked. The sheet S may be an original sheet or a recording sheet.

Figure 2:
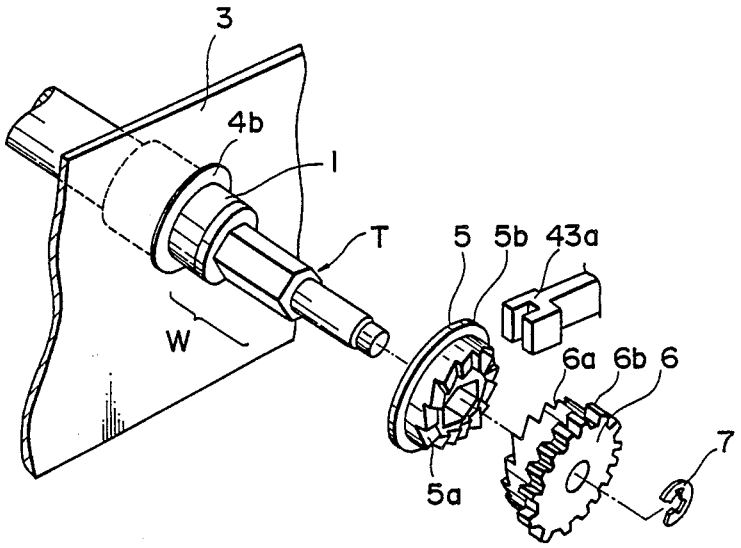
FIG. 2 is an exploded perspective view of a rotary shaft shown in FIG. 1.

More particularly, in FIG. 2 showing the details of the clutch portion, the rotary shaft 1 includes a polygonal (hexagon in the illustrated embodiment) shaft portion in an area W. On the other hand, the slidable dog clutch 5 has a central polygonal opening adapted for insertion of the polygon of the polygonal shaft portion with some clearance.

Accordingly, when the slidable dog clutch 5 is inserted onto the rotary shaft 1, the slidable dog clutch can be axially slid through the range W. Further, the slidable dog clutch 5 includes a flange on which a recessed end 43*a* of a clutch mechanism (described later) is pivotally supported. As already stated, the dog clutch 6 is also mounted on the rotary shaft 1. A toothed face 6*a* of the dog clutch 6 and a toothed face 5*a* of the slidable dog clutch 5 are set to face each other. An end and another end of the dog clutch 6 is limited to move on the rotary shaft 1 in the sliding direction by the E-ring 7, however, both ends are rotatable around the rotary shaft.

Further, the dog clutch 6 has a gear portion 6*b* formed integrally therewith. Referring to FIG. 1, a motor 8 fixedly mounted on the right side plate 3 has a motor shaft 9 on which a motor gear 10 is fixed. Further, an idler gear 12 is rotatably mounted on a stud 11 fixed to the right side plate 3, the idler gear 12 being prevented from slipping off the stud 11 by means of an E-ring 7′ or and the like. The idler gear includes a large gear portion 12*a* meshed with the motor gear 10 and a small gear portion 12*b* which is integrally formed with the large gear portion 12*a* and meshed with the gear portion 6*b* of the dog clutch 6.

Accordingly, when the motor 8 is energized to rotate the motor gear 10 in a direction shown by an arrow a, the idler gear 12 is rotated in a direction shown by an arrow b, and then the dog clutch 6 is rotated in a direction shown by an arrow c.

(Rocker member 13)

Next, a rocker member 13 will be explained hereinafter. The rocker member 13 is provided at both sides with bearing holes 13*a* and 13*b* (FIG. 1) by which the rotary member is rotatably mounted on the rotary shaft 1.

On the upper side of the rocker member 13, as viewed in FIG. 1, there is rotatably mounted a cam follower roller 14 which bears against a cam plate 30 which will be described later. A pressing force (shown by an arrow F in FIG. 3) by which the cam follower roller 14 is pressed against the cam plate 30 is obtained by a spring 15 bridged with tension between an upper portion of the rocker member 13 and the left side plate 2.

Figure 3:
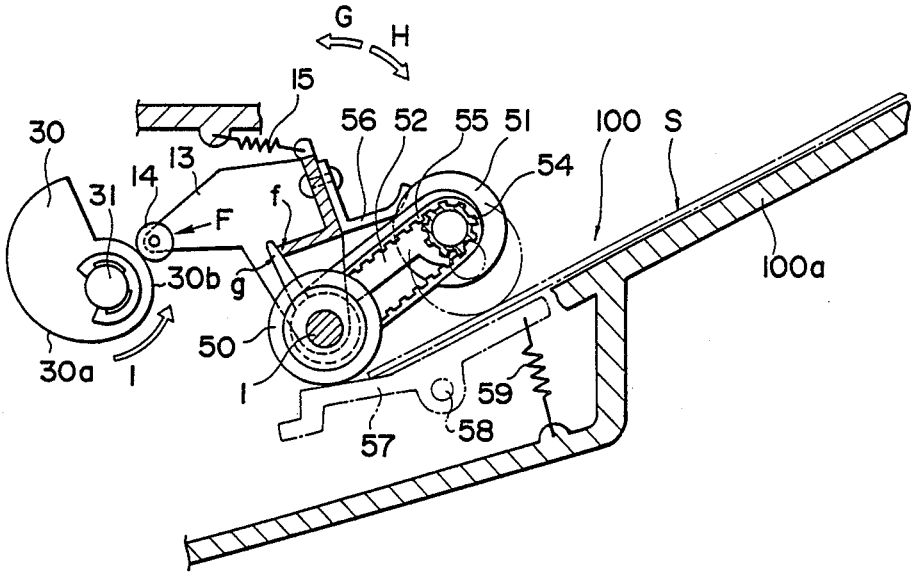
FIG. 3 is a sectional view taken along the line A—A of FIG. 1.

Further, the cam plate 30 is adapted to rotate around a cam stud 31 fixed to the left side plate 2 and is prevented from slipping off the cam stud by means of the E-ring 7 or the like. A cam gear 32 is integrally formed on the cam plate 30. Further, a cam motor 33 for rotating the cam plate 30 is attached to the left side plate 2. A cam motor gear 34 fixed to a motor shaft 35 of the cam motor 33 is meshed with the cam gear 32 to transmit rotational force of the cam motor 33 to the cam plate 30. FIG. 3 shows the condition that the cam follower roller 14 bears against a smaller-diametered portion 30*b* of the cam plate 30, and, therefore, the rocker member 13 has been rocked in a direction shown by an arrow G.

Accordingly, when the cam follower roller 14 encounters a large-diametered portion 30*a* of the cam plate 30 after the cam plate 30 is rotated in a direction I by the motor 33, the rocker member 13 is rocked toward a direction shown by an arrow H. An inclined plate portion 13*c* (FIG. 1) is integrally formed on a part of the right side plate 3 of the rocker member 13.

(Clutch assembly)

A clutch stud 46 is fixed to the right side plate 3 and protruded therefrom. On the clutch stud 46, a second clutch member 42 having a bearing rotatably supporting a clutch roller 41, and a first clutch member 43 having one end including the afore-mentioned recessed portion 43*a* are rotatably mounted in a manner shown in FIG. 1. These clutch members are so provided as to be axially slidable by a guide member, not shown, and rotatable around an axis.

Further, a first compression spring 44 and a second compression spring 45 cooperating with the first and second clutch members 43, 42 are arranged around the clutch stud 46 as shown in FIG. 1. The clutch roller 41 bears against the inclined plate portion 13*c* of the rocker member 13. A pressing force by which the clutch roller 41 is pressed against the inclined plate portion 13*c* is obtained by the second compression spring 45.

A compression force from the second compression spring 45 acts on the clutch roller 41 through the second clutch member 42. Further, the second compression spring 45 also urges or biases the first clutch member 43 to a position shown by a solid line. In this position, since the recessed portion 43*a* of the first clutch member 43 is engaged by the flange 5*b* of the slidable dog clutch 5, the dog clutch 5 is also urged to a position shown by a solid line. An E-ring 47 attached to the clutch stud 46 at the other end of the second compression spring 45 prevents this compression spring 45 from slipping off the clutch stud and bears the reaction force of the compression spring.

Further, the first compression spring 44 positioned between the second and first clutch members 42 and 43 prevents direct abutment between the toothed faces of the dog clutches 5 and 6 when the slidable dog clutch 5 is meshed by the dog clutch 6, as will be explained later. Further, the first compression spring 44 also applies pressure to the toothed faces of the dog clutches when these toothed faces are meshed with each other.

(Roller assembly)

A sheet feeding roller (a separating roller) 50 is fixedly mounted on the rotary shaft 1 in the vicinity of a generally central portion of a sheet passage 100, a first timing pulley 53 being formed integrally with the sheet feeding roller 50. On the other hand, a pick-up roller 51 is rotatably supported by bearings arranged in a rockable arm member 52 rotatably mounted on the rotary shaft 1. Between a second timing pulley 54 formed integrally with the pick-up roller 51 and the first timing pulley 53, a timing belt 55 is bridged so that these timing pulleys are operated in synchronism with each other. Accordingly, when the rotary shaft 1 is driven, the separating roller 50 and the pick-up roller 51 are synchronously rotated.

The arm member 52 is provided with projections g (FIGS. 1 and 3). When the cam plate 30 is rocked in the direction of an arrow G so that portions f of the rocker member 13 are pressed against the projections g of the arm member by the action of the spring 15, the pick-up roller 51 is maintained in a lifted position.

Figure 4:
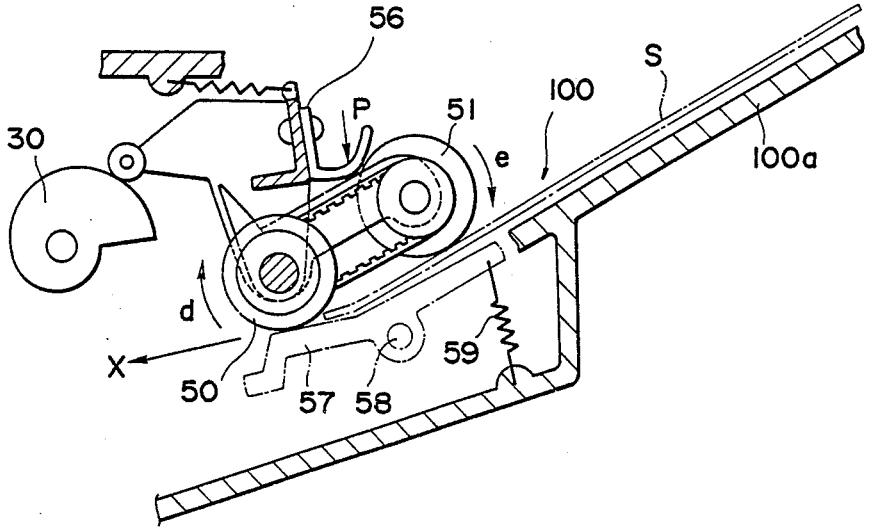
FIG. 4 is a sectional view taken along the line A—A of FIG. 1 and shows a different state than in FIG. 3.

FIG. 4 shows the condition in which the pick-up roller 51 is lowered after the cam plate 30 has been rotated in the direction I. In FIG. 4, a pressing force exerted on the sheet S by the pick-up roller 51 is obtained by applying to the arm member 52 a spring force generated when a leaf spring 56 fixed by a rivet or the like to the rocker member 13 shifts the arm member 52 in a direction shown by an arrow P.

Further, at a position opposed to the roller assembly a separating plate 57 is rotatably mounted on a shaft 58 fixed to the frame of the apparatus. The separating plate 27 has one end bridged with tension spring 59, so that the separation roller 50 is in contact under pressure with the other end of the separating plate 57. The separating plate 57 is provided for feeding out only one sheet S among a plurality of sheets.

(Operation)

Next, an operation of the sheet feeding mechanism constructed as mentioned above will be explained. FIG. 3 shows the condition in which the cam follower roller 14 of the rocker member 13 is in contact under pressure with the small-diametered portion 30*b* of the cam plate 30 and the pick-up roller 51 is spaced from the sheet S. In this condition, since the rotational force is not transmitted to the rotary shaft 1, even if the end of the sheet S contacts the separation roller 50, the sheet S is not fed out. Thereafter, when the cam plate 30 is rotated in the direction I, the rocker member 13 is rocked in the direction H. As a result, the pick-up roller 51 is pressed against the sheet S by the spring force of the lead spring 56 as shown in FIG. 4. In synchronism with the rocking movement, the rotational force of the motor 8 is transmitted to the rotary shaft 1 through the clutch mechanism. In this case, the meshing force of the clutch members is effected by the inclined plate portion 13*c* formed on the rocker member 13.

In FIGS. 1 and 3, when the rocker member 13 is swung or rotated in the direction H, the inclined plate portion 13*c* is similarly rotated and moves to a direction shown by an arrow X. On the other hand, as previously stated, since the clutch roller 41 is rotatably in contact under pressure with the inclined plate portion 13*c*, when the rocker member 13 is inclined in the direction X and the inclined plate portion 13*c* is moved to a position shown by a broken line, the clutch roller 41 is also shifted in a direction Y to a position shown by a broken line.

That is to say, the rotational movement of the rocker member 13 around the rotary shaft 1 is converted to a linear motion through the inclined plate portion 13*c* and the clutch roller 41. When the clutch roller 41 is shifted in the direction Y and the second clutch member 42 is shifted to a position as shown by the alternate long and short dash line in FIG. 1, the first compression spring 44 held by the clutch stud 46 in the second clutch member 42 is compressed. Consequently, the compression force of the first compression spring 44 acts on the first clutch member 43, thus shifting this first clutch member 43 in the direction Z. As stated above, since the first clutch member 43 has the recessed portion 43*a* for holding the flange 5*b* of the slidable dog clutch 5, the shift or displacement of the first clutch member (in the direction Z) causes the slidable dog clutch 5 to engage with the dog clutch 6.

Since the rotational force of the motor 8 has been transmitted to the dog clutch 6, the rotational force in the direction C is transmitted to the rotary shaft 1.

FIG. 4 shows the condition in which the rotational force has been transmitted to the separation roller 50 and the pick-up roller 51 to rotate these rollers in directions d and e, respectively.

Accordingly, the sheet S is fed in a direction X by the frictional force from the pick-up roller 51 and the separation roller 50. In this case, the separating plate 57 cooperates with the separation roller 50 to feed only the uppermost sheet of the stacked sheets.

Explaining the principle briefly, when a coefficient of friction between the separating plate 57 and the sheet S is $\mu 1$, a coefficient of friction between the sheets is $\mu 2$, and a coefficient between the separation roller 50 and the sheet S is $\mu 3$, only the uppermost sheet S can be fed alone in the direction X (FIG. 4), by maintaining the relation $\mu 3 > \mu 1 > \mu 2$. After the single sheet S is fed out, the cam plate 30 is rotated in a direction opposite to the direction shown by the arrow I, thus disengaging or releasing the clutch mechanism, thereby stopping the transmission of the rotational force to the rotary shaft 1. Thus, the paper feed comes to a waiting state.

As mentioned above, according to the present invention, the sheet can be fed only by using a rotating means comprising the cam motor 33 and motor 8 as driving sources. Since these driving sources can be effectively operated by appropriate sheet detector and control circuits (not shown), consumption power can be reduced and the power source can be compact. Further, although an example of the cam plate 30 as cam means was explained, it is possible to perform a function such as engagement and disengagement of a read sensor (among other functions to be performed in synchronism with the paper feed operation by the sheet feeding apparatus according to this embodiment of the present invention), by providing second and third cam plates and the like integrally with the cam plate 30. Further, the separating roller 50 and/or the pick-up roller 51 are not limited to rollers; for example, these means can be constructed by a rotating or turning member which can feed a sheet, such as an endless belt entrained around rotatable pulleys.

Therefore, according to this embodiment of the present invention, the sheet feeding apparatus which is highly reliable and which is constituted by the least driving sources and constructural parts can be provided at a low cost.

Figure 5:
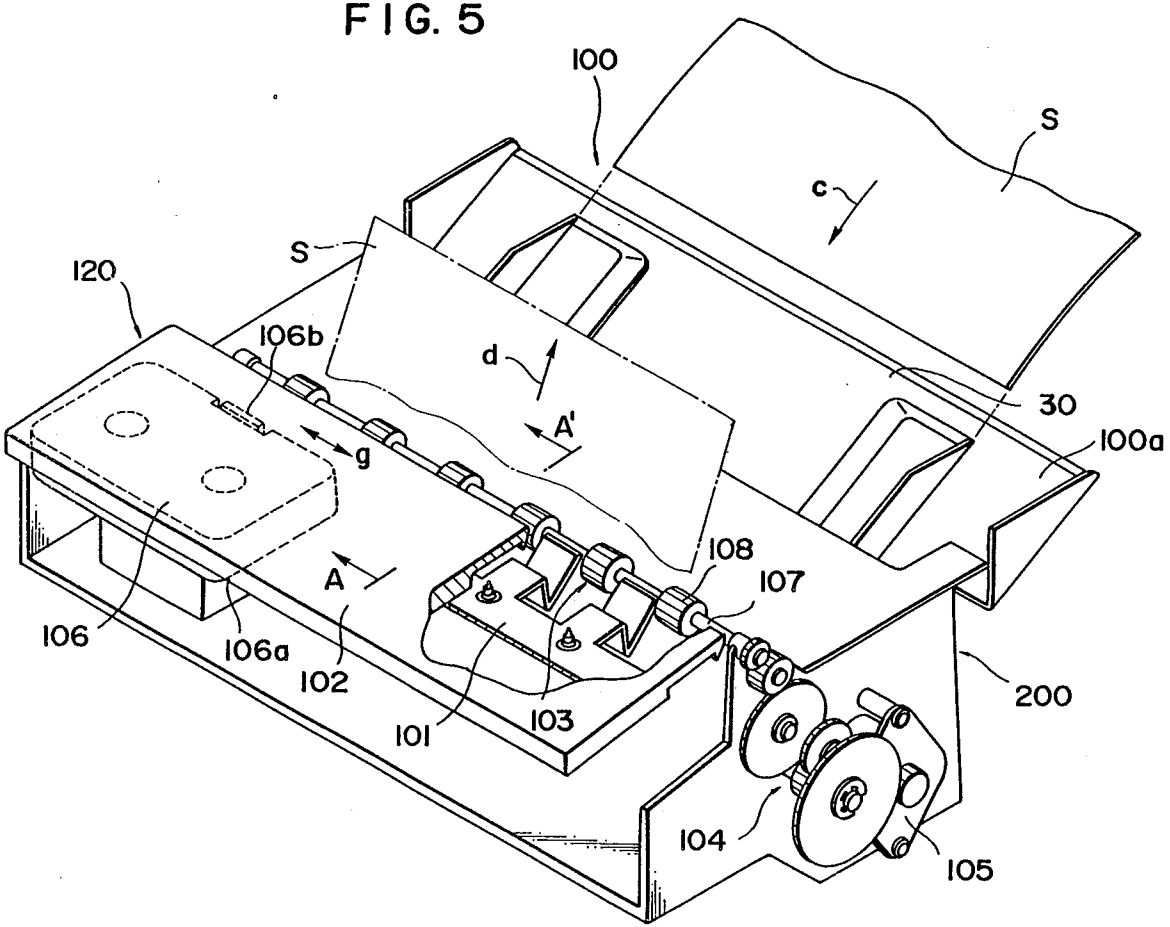
FIG. 5 is a partially broken perspective view of a printer incorporating the sheet conveying apparatus of FIG. 1 therein.

Next, FIG. 5 shows a perspective view (Partly sectioned) of a portion of a printer incorporating the above-mentioned sheet feeding apparatus therein. The printer explained later comprises a sheet discharging mechanism including discharging rollers, and a resilient member for pressing the sheet against the discharging rollers. The discharging rollers being arranged at predetermined intervals on a shaft having a diameter smaller than that of each discharging roller. Each resilient member has an end which enters from the outer peripheral surfaces of the discharging rollers toward the shaft when the sheet is not being fed. The other ends of the resilient members, which is on a side opposed to the discharging rollers, are formed integrally with a base portion fixed to a support. The resilient members have a first bent portion and a second bent portion extending from the first bent portion to the end on the side of the discharging rollers. When the sheet is fed, the resilient members can be deformed to be bent around the base portion and around the first bent portion in accordance with the rigidity of the sheet.

Accordingly, in the printer shown in FIG. 5 and incorporating the above-mentioned sheet conveying apparatus therein, when the sheet to be fed is thin, the discharging spring (resilient member) is bent around its base portion, thereby applying a proper resilient force onto the thin sheet in accordance with the rigidity of the thin sheet. On the other hand, when the sheet to be fed is thick, the resilient member is bent around its first bent portion, thereby applying a proper resilient force onto the thick sheet in accordance with the rigidity of the thick sheet.

In FIG. 5, the afore-mentioned loading plate 100*a* is arranged behind a body 200 of the printer. The sheets S are inserted from a direction shown by an arrow C. A printing mechanism 120 is arranged at a front portion of the body 200 and performs a printing operation with respect to the sheet S. Incidentally, in the illustrated embodiment, an inked ribbon cassette 106 is mounted on a mounting section 106*a* reciprocally movable in a direction of the width of the sheet S (in a direction g), and a thermal head 106*b* attached to the mounting section 106*a* presses the inked ribbon against the sheet to perform head-transfer recording.

A rotational force of a motor 105 fixed to a side plate of the body 200 is transmitted to the discharging rollers 103 through a gear device 104. The discharging rollers 103 are rotatably supported in the body 200. The discharging rollers 103 are integrally constituted by a core shaft 107 and rubber rollers 108. The rubber rollers 108 are arranged equidistantly along the core shaft, and thus exposed portions of the core shaft (portions not covered by the rubber rollers) are also equidistantly arranged.

Now, an inked ribbon cover 102 is removably attached to a body cover (not shown) at a predetermined position. A discharging spring 101 is fixed to the back of the inked ribbon cover 102 by means of screws. The discharging spring 101 comprises projection pieces which enter the exposed portions of the core shaft 107.

Figure 6A:
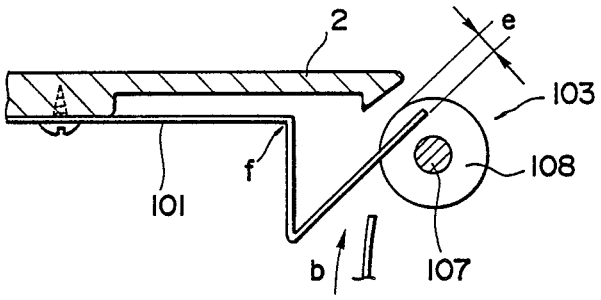
FIGS. 6A–6C are sectional views taken along the line A–A' of FIG. 5.
Figure 6B:
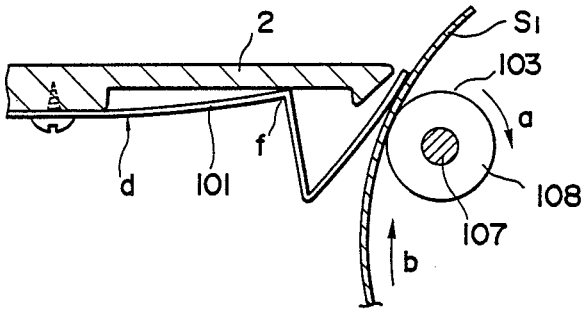
Figure 6C:
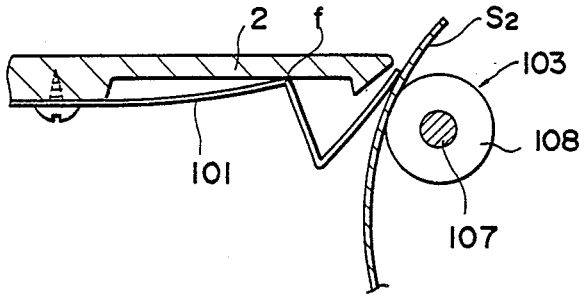
Figure 7A:
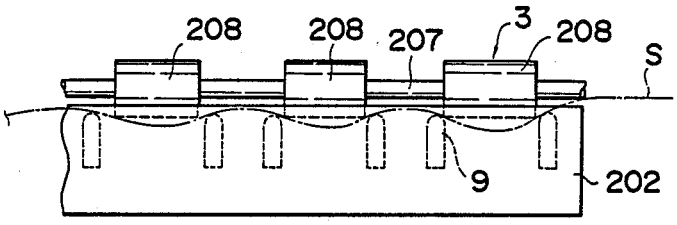
FIGS. 7A–7E show a conventional sheet conveying apparatus arranged in a sheet conveying section.
Figure 7B:
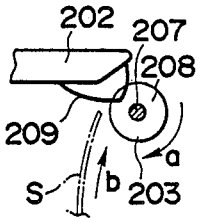
Figure 7C:
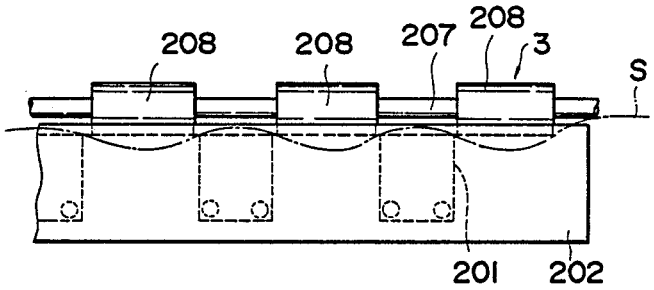
Figure 7D:
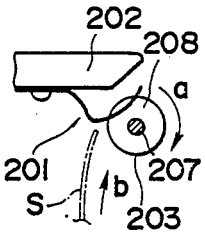
Figure 7E:
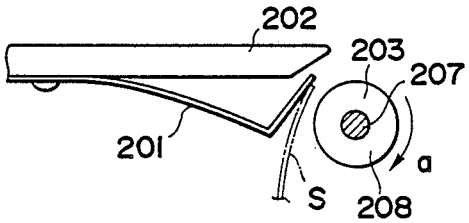

In FIGS. 6A, 6B and 6C showing sectional views taken along the line A—A' of FIG. 5, FIG. 6A shows a condition in which the sheet S is not being fed. In this condition, since the discharging spring 101 is not subjected to an external force, each projection piece of the discharging spring 101 projects toward the corresponding exposed portion of the core shaft 107 by a distance e from the outer peripheral surface of the rubber roller 108 to the core shaft 107.

In the sheet discharging mechanism so constructed, when the sheet is fed from a direction b by the afore-mentioned sheet conveying means, the sheet is pinched between the discharging spring 101 and the discharging rollers 103 rotating in a direction a and then is discharged.

FIG. 6B shows a condition in which a thin sheet S1 having relatively small rigidity is pinched and conveyed between the discharging spring 101 and the discharging rollers 103. In this condition, the discharging spring 101 is bent at a fulcrum d in balance with the rigidity of the thin sheet S1.

FIG. 6C shows a condition in which a thick sheet S2 having relatively high rigidity is pinched and conveyed between the discharging spring 101 and the discharging rollers 103. In this condition, the discharging spring 101 is bent more than in the case of the thin sheet S1, due to the higher rigidity of the thick sheet. Consequently, a bent portion f of the discharging spring 101 is engaged with the back of the ribbon cover 102 which supports the discharging spring 101 to balance with the rigidity of the thick sheet S2. In this condition, since the discharging spring 101 is bent at the bent portion f, as a fulcrum the pressure acting on the thick sheet S2 by the discharging spring 101 further increases.

In this way, since the discharging spring 101 acts in balance with rigidity of any sheet, the sheet is always subjected to an optimum pressure.

Incidentally, in this embodiment, although an example of the leaf spring having predetermined resilience was explained as the discharging spring, such spring (resilient means) can be comprised of a rod-shaped elastic member or sponge-like elastic member or the like.

As explained above, according to the present invention, a sheet conveying apparatus which is more compact and improves the reliability in the sheet conveying operation can be provided.

I claim:

1. A sheet conveying apparatus for conveying a sheet comprising:

a separation rotary member for separating a single sheet from a plurality of sheets and feeding the sheet;

a supply rotary member for supplying the sheets toward said separation rotary member;

driving means for generating a driving force to rotate said separation rotary member;

intermission means for intermitting the transmission of the driving force from said driving means;

operating means for shifting said supply rotary member between a supplying operation position and retracted position retracted from said supplying operation position;

driving force transmitting means for performing the intermission of said intermission means, in synchronism with the shift of said supply rotary member between said supplying operation position and said retracted position by said operating means.

2. A sheet conveying apparatus comprising:

a rotatably supported rotary shaft;

a sheet conveying roller means attached to said rotary shaft for feeding a sheet;

driving means for driving said rotary shaft; and clutch means for controlling so as to or not to transmit the driving force generated by said driving means to said rotary shaft or not, wherein said clutch means includes a first engagement member provided at one end of said rotary shaft for slidable movement in an axial direction of said rotary shaft and for rotation together with said rotary shaft, a second engagement member which can be engage by said first engagement member and which is rotated around said rotary shaft by a rotational force from said driving means, a rocker member rotatably supported by said rotary shaft, rotation transmission means provided on a part of said rocker member, and transmission means for converting a rotating motion of said rocker member to a reciprocating motion of said first engagement member.

3. A sheet conveying apparatus as set forth in claim 2, wherein said rocker member is rocked by a cam.

4. A sheet conveying apparatus as set forth in claim 2, wherein a pick-up roller assembly constituted by a pick-up roller rotated in synchronism with said sheet feeding roller means and an arm member rotatably mounted on said rotary shaft for rotatably supporting said pick-up roller receives a rotational force from said rocker member.

5. An image recording apparatus for recording an image on a recording sheet, comprising a separation rotary member for separating a single recording sheet from a plurality of recording sheets and feeding the recording sheet;

a supply rotary member for supplying the recording sheets toward said separation rotary member;

driving means for generating a driving force to rotate said separation rotary member;

intermission means for intermitting the transmission of the driving force from said driving means;

operating means for shifting said supply rotary member between a supplying operation position and retracted position retracted from said supplying operation position;

driving force transmitting means for performing the intermission of said intermission means, in synchronism with the shift of said supply rotary member between said supplying operation position and said retracted position by said operating means; and a recording means for recording an image on said recording sheet.

* * * * *

UNITED STATES PATENT AND TRADEMARK OFFICE

CERTIFICATE OF CORRECTION

PATENT NO. : 4,900,003

DATED : February 13, 1990

INVENTOR(S) : KENICHIRO HASHIMOTO

It is certified that error appears in the above-identified patent and that said Letters Patent is hereby corrected as shown below:

COLUMN 4, line 35, "and" should be deleted.

COLUMN 7, line 53, "Partly" should read --partly--.

Signed and Sealed this

Twenty-ninth Day of January, 1991

*Attest:*

HARRY F. MANBECK, JR.

*Attesting Officer*

*Commissioner of Patents and Trademarks*